United States Patent [19]

Bell, Jr. et al.

[11] 4,231,593

[45] Nov. 4, 1980

[54] CHECK WITH ELECTRICALLY CONDUCTIVE LAYER

[75] Inventors: Vincent G. Bell, Jr., Berwyn; Thomas P. Burke, Harleysville, both of Pa.; George D. Margolin, Newport Beach; Victor V. Vurpillat, Laguna Niguel, both of Calif.

[73] Assignee: Centurion Data Corporation, King of Prussia, Pa.

[21] Appl. No.: 879,114

[22] Filed: Feb. 21, 1978

[51] Int. Cl.[3] ..... B42D 15/00

[52] U.S. Cl. ..... 283/6; 283/9 R; 283/58

[58] Field of Search ..... 283/6–9 R, 283/58, 57–59; 428/916, 204, 209, 211; 235/488; 40/2.2

[56] References Cited

U.S. PATENT DOCUMENTS

| | | | |
|---|---|---|---|
| 1,175,058 | 3/1916 | Heltsley | 283/58 |
| 1,671,418 | 5/1928 | Frankel | 283/8 R |
| 1,865,610 | 7/1932 | Blair | 283/8 |
| 1,866,400 | 7/1932 | Doushkess | 283/8 R |
| 1,929,828 | 10/1933 | Schlitz | 283/8 |
| 2,083,206 | 6/1937 | Schoeller | 154/46 |
| 2,396,391 | 3/1946 | Ross | 117/1 |
| 3,405,256 | 10/1968 | Weber | 235/488 |
| 3,662,156 | 5/1972 | Grosbard | 235/61.12 |
| 3,672,703 | 6/1972 | Jay | 282/25 |
| 3,802,724 | 4/1974 | Gosnell | 283/9 |
| 3,831,119 | 8/1974 | Ambrosio | 235/488 |
| 3,833,395 | 9/1974 | Gosnell | 117/1 |
| 3,869,082 | 3/1975 | Ludin | 235/61.11 H |
| 3,895,220 | 7/1975 | Nelson et al. | 235/61.12 N |
| 3,902,262 | 9/1975 | Colegrove et al. | 40/2.2 |
| 3,950,013 | 4/1976 | Tagliaferri | 283/6 |
| 3,998,315 | 12/1976 | Phillips | 197/1 R |
| 4,009,892 | 3/1977 | Nickerson | 283/6 |
| 4,020,278 | 4/1977 | Carré et al. | 358/128 |

*Primary Examiner*—John McQuade
*Attorney, Agent, or Firm*—David S. Woronoff

[57] ABSTRACT

A check has first and second coatings one of which is electrically conductive and the other electrically non-conductive. The coatings are of contrasting colors and one of the coatings is electrically vaporizable for exposing the underlying coating during a "write" operation. The coatings may overlay a base material to form a three layer structure or the base material itself may function as one of the coatings of appropriate color and conductivity. The check is composed of at least two segments, a negotiable segment which may be fed back to a terminal device for a machine "read" operation. The memory segment may be formed into one or more memory parts on the negotiable segment, the stub portion and on the memory segment. One or more of these memory parts may be easily detached. The check described above combines uniquely with an input-output device which can read from it and write on it.

33 Claims, 3 Drawing Figures

CHECK WITH ELECTRICALLY CONDUCTIVE LAYER

CROSS REFERENCE TO RELATED APPLICATIONS

The present invention is related to three other patent applications filed to the same date as the present application and assigned to a common assignee. Those applications are:

1. "Business Forms" invented by Thomas P. Burke, Vincent G. Bell, Victor V. Vurpillat and George Margolin, Ser. No. 879,113.
2. "Computer Input-Output Device" invented by Victor V. Vurpillat and George Margolin; Ser. No. 879,116.
3. "Computer System" invented by Victor V. Vurpillat and George Margolin, Ser. No. 879,115.

BACKGROUND OF THE INVENTION

A. Field of the Invention

The present invention relates to checks and more particularly to checks which can be read from or written on electronically. The present invention relates to a novel check which is essentially fraud proof even in view of the modern color copier devices. The present invention also relates to a novel check structure in which one part forms the input for a computer.

B. Prior Art

A brief view of the prior art submitted with the present application is in an accompanying patentability statement. However, the closest prior art is U.S. Pat. No. 3,869,082 which shows a capacitively readable document. The document is formed of an electrically conductive material in which one or more holes may be punched. The conductive coating is preferably laminated between layers of plastic. Such a document can not be written on electrically or conveniently read optically among other differences from the present invention.

SUMMARY OF THE INVENTION

The present invention discloses a novel check or negotiable instrument having at least two coatings or layers. One of the layers functions as a base layer. The two coatings are of contrasting color and of significantly different electrical conductivity. The check itself is normally opaque to visible light. Another embodiment of the present invention has a base material with two layers placed thereon. The layers are of contrasting colors and electrical conductivity.

The second or upper layer is of a type which can be vaporized electronically by a short exposure (up to about 0.0004 of a second) to a voltage of about 40 to 100 volts. After the second or upper coating has been vaporized the check may be read both optically, resistively, conductively or capacitively. When read electronically a section of the check form may operate as the memory for a computer. The data constituting the memory may be written on the check in one or more places on the check, the stub or on a separate memory segment.

The upper coating or layer is of such a nature that any attempt to remove it by an unauthorized party will further expose the under coating of contrasting color thereby showing the attempt at alteration.

The upper layer also has a smooth glossy surface which is essentially totally repellant to any fluid of relatively high surface tension such as water based inks or xerographic toners during the fusing stage. These properties of the upper layer result in a check paper which cannot be copied onto by a xerographic or electrostatic copier and the shiny surface appearance which cannot be reproduced by any known xerographic or electrostatic color or black and white copier.

One of the special properties of the inventive check is that it may be written on and read from a bilateral (two way) electrosensitive reader-printer terminal device disclosed in a co-pending application referred to previously. Such a device can vaporize the metal layer as described above to write on the check. Similarly the reader can read what has been written either capacitively, conductively, or resistively.

In the most common configuration of the present invention the base material will be formed from a paper having a weight of about 24 pounds (or about 60 pounds per 10 reams). The first layer or undercoating will be an ink of any contrasting color such as black, red, blue or the like. The second or upper layer will be of aluminum or other similar electrical conductor which will be formed by vapor deposition on top of the ink coating. A third coating or layer of another ink, which may be any color, may be placed over the aluminum to reduce glare and improve readability without altering the ink absorbing properties of the upper coating. The third layer may be formed from an ink which has either infra-red or ultra-violet absorbing properties. Such inks are then dried by passing them through infra-red or ultra-violet ovens. On top of the third coating may be printed in magnetic or other inks relevant bank and account information commonly printed on checks presently. In practice the MICR ink and other specific bank and account information may be printed in the same step with the third layer.

DESCRIPTION OF THE INVENTION

Figure 1:
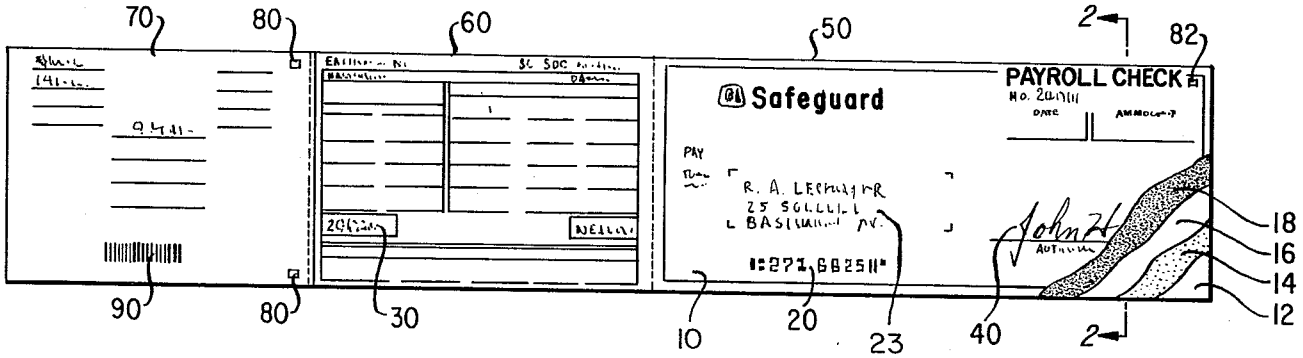
FIG. 1 shows a plan view of an embodiment of the present invention.
Figure 2:
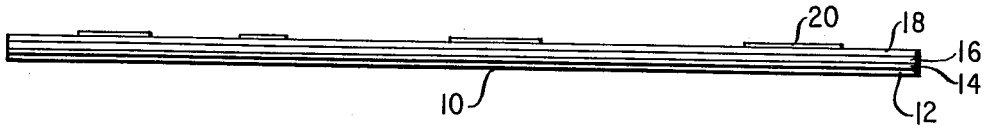
FIG. 2 shows a sectional view of the embodiment shown in FIG. 1 taken along the line 2—2 shown in FIG. 1.
Figure 3:
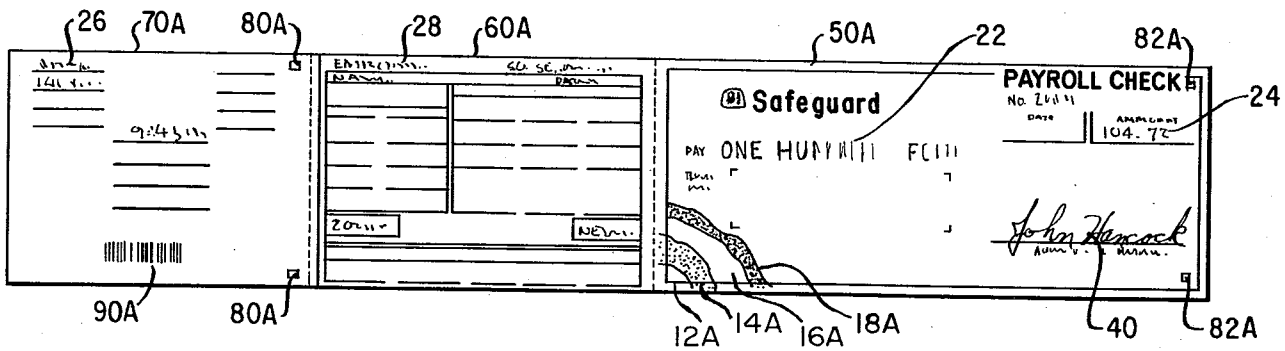
FIG. 3 shows a plan view of a second embodiment of the present invention.

FIGS. 1 and 3 show a check 10, 10A having a base layer 12, 12A, which may be formed from paper plastic or other suitable material. The material should preferably have sufficient stiffness to be able to pass non-destructively through or be passed over non-destructively by an electro-sensitive reader, writer or combination reader-writer. One such base layer is formed from bond paper having a weight in the 20 to 30 pound range (i.e. 50 to 75 pound offset paper). A first layer or undercoating of ink or other coloring material 14, 14A is applied to the base 12, 12A. The layer 14, 14A should normally be of a color readily visible to the unaided human eye and is normally electrically non-conductive. A second or upper layer 16, 16A is deposited on top of the first layer 14, 14A. The second layer 16, 16A can be formed of a coat of aluminum having a thickness normally sufficient to be opaque to visible light. The second layer 16, 16A is electrically conductive thereby requiring that it be metallic or a doped non-metal. The color of the second layer 16, 16A contrasts with that of the first layer 14, 14A. Where a portion of this coat is removed the electrical properties (resistance or capacitance) of the structure is altered.

Although the normal order of first and second coats 14, 14a 16, 16A is ink and aluminum respectively. The order may be reversed so that the first coat 14, 14A is conductive and the second coat 16, 16A non-conductive. It is important that whichever material is chosen for the upper layer 16, 16A that it be vaporized by a relatively short exposure to an electronic signal of about 40 to 100 volts and of time duration about 0.0004 seconds. The second layer 16, 16A normally has a smooth hard finish so that it will not absorb water or other liquid base inks where the liquids have relatively high surface tension and wet a surface to adhere. Therefore water based inks (inks which wet surfaces) and xerographic and the like toner in the liquid state will not adhere to layer 16, 16A. Although the present invention has been described as a three layer structure it may also be a two layer structure. In that embodiment the first and second layers are of different color and conductivity and the first layer functions as the base layer.

A third layer or coating 18, 18A may be put down on top of all or a portion of the second layer 16, 16A. FIG. 1 shows the third layer on all of the check while FIG. 3 shows it only on the negotiable instrument portion of the check. The third layer or coat 18, 18A may be of standard offset ink or it may be an offset ink having ultra-violet or infra-red energy absorbing properties so that such ink may be dried rapidly in an oven using infra-red or ultra-violet energy. The third layer 18, 18A may be applied to make the second layer easier to read and to reduce glare. Check or negotiable instrument 10, 10A as shown in FIG. 1 and 3 may be organized into three parts, negotiable segment 50, 50A, stub segment 60, 60A and memory segment 70, 70A.

The negotiable segment may have MICR characters 20 printed thereon to indicate bank and account information. Similarly the bank name, depositor name and the like may be printed in magnetic inks as shown in the Figures.

The negotiable segment may have printed electronically as shown in FIG. 3, the amount of the check in numbers at two places 22 and 24 and the payee's name and address 23. The electronic writing creates a distinctive appearance and exposes the underlayer 14, 14A which has the contrasting color of ink such as red, blue or black.

The information shown on the negotiable segment is repeated in the stub segment 60, 60A as shown at 30 and 28 in FIGS. 1 and 3, respectively. The writing in sections 50, 50A and 60, 60A is designed to be read by the human eye, i.e., optically with or without code.

The third section or memory stub segment 70, 70A of the check is encoded for bar code or binary code 90, 90A as shown in FIG. 3. But other machine readable codes may be used. Additional human readable information 26 may be displayed on the memory stub segment 70, 70A.

Memory stub 70, 70A which is machine readable may serve as the memory or storage function of the computer. Although the third section 70, 70A is called a memory stub. The data (machine and optically readable) to be stored may be printed in more than one place on the check including both stubs 60, 60A and the negotiable segment 50, 50A. Therefore these sections may function as memory elements also. Registration mark 80, 80A shown on the memory portion or segment 70, 70A enable a reader or writer (not shown in this application but shown in one of the co-pending applications Ser. No. 879,116, entitled "Computer Input-Output Device") to know when segment 70, 70A is properly positioned to accept its data. Similar registration marks 82, 82A are shown on the negotiable instrument segment 50, 50A shown in FIGS. 1 and 3. The registration marks which may appear on any or all segments of the check have horizontal, vertical and timing information contained in them.

An ink absorbtive patch 40 may be applied to the negotiable portion of the check to enable signature by a water based ink. Ball point inks are accepted by any portion of the check surface.

Other embodiments of the present invention can be devised by those skilled in the art. Such embodiments are clearly within the scope of the present invention as described in the appended claims. The various layers may be coatings, inks, colors, dispersed or suspended in other materials. The invention is believed to apply to any method or structure for producing the multi-layered check.

In summary, the present invention shows a novel check structure and form which may be used in connection with an electro-sensitive reader, printer or reader-printer which is essentially fraud proof, unique appearing, which has the ability to be machine read and optically (humanly) read and to have a portion thereof function as a computer memory.

What is claimed is:

1. A negotiable instrument comprising in combination:

a first layer, a second layer overlying said first layer, and said layers having substantially different electrical conductivities and colors wherein at least one of said layer is opaque to light and one of said layers being electrically vaporizable by exposure to an electrical discharge.

2. The article claimed in claim 1 wherein:

a third layer overlying said second layer, said third layer having a color contrasting with that of both of the first and second layers.

3. The article claimed in claim 1 wherein:

one of first and second layers is formed of a coloring material and the other of said layers is formed of an electrically conductive substance.

4. The article claimed in claim 1 wherein:

said second layer is substantially impervious to fluids which wet surfaces.

5. The article claimed in claim 1 wherein:

one of said first and second layers is electrically vaporizable by a voltage of about 50 volts lasting for about 0.0004 of a seconds.

6. The article claimed in claim 1 wherein:

the absence of a portion of said second layer changes the electrical characteristics of the article in the region of the absent layer.

7. The article claimed in claim 1 wherein:

said article is adapted to be fed into a reader-writer device to electrically read and write onto said article by removing a portion of said second layer and by sensing said removal.

8. The article claimed in claim 1 wherein:

said first layer comprises a plurality of colors.

9. The article claimed in claim 1 including further:

a base layer underlying said first and second layers.

10. The article claimed in claim 9 wherein:

said base layer is a paper substance;
said first layer is an ink substance; and,
said second layer is an aluminum material.

11. The article claimed in claim 9 wherein:
said base layer is a plastic.

12. The article claimed in claim 1 wherein:
said first layer is formed of a plastic.

13. The article claimed in claim 1 wherein:
said first layer is formed of a paper.

14. The article claimed in claim 10 wherein:
a third layer of ink of a contrasting color is deposited on top of said second layer;
said third layer of a thickness such that the shiny surface of the aluminum layer is visible through said third layer and the fluid absorbing properties of said second layer are not altered.

15. The article claimed in claim 14 wherein:
said negotiable instrument is divided into at least two segments in which at least one of the said segments contains a computer readable memory part for providing the memory input to a computer.

16. The article claimed in claim 15 wherein:
said memory part has at least one portion of said second layer removed in a manner corresponding to a machine readable code.

17. The article claimed in claim 16 wherein:
at least one of said segments has at least one mark formed thereon for enabling the position of said segment to be sensed by a terminal device.

18. The article claimed in claim 16 wherein:
at least one of said segments has a plurality of timing marks formed thereon.

19. A negotiable instrument for being written on and read by a computer terminal device comprising at least first and second layers in which said first layer is electrically non-conductive and said second layer is electrically conductive; said layers being of contrasting colors; said second layer being electrically vaporizable by exposure to an electrical discharge.

20. The article claimed in claim 19 wherein:
the surface of the negotiable instrument is organized into at least first and second segments in which at least one of said first and second segments contains data in a machine readable language.

21. The article claimed in claim 20 wherein:
said negotiable instrument second segment is organized into two portions, one being a negotiable portion and the other being a stub portion.

22. The article claimed in claim 19 wherein:
a third layer is placed over said first and second layers in which said third layer does not substantially alter the surface appearance or liquid absorption properties of the second layer and is of a color contrasting to both said first and second layers.

23. The article claimed in claim 19 wherein:
said first and second layers are deposited on a paper base and said second layer is formed of a thin sheet of metal having a surface non-absorptive to liquid which wet surfaces they touch.

24. The article claimed in claim 20 wherein:
said first layer is formed from an ink and said second layer is aluminum.

25. The article claimed in claim 22 wherein:
a coating of liquid absorbing material is adhered to one of said second or third layer to accept a signature.

26. The article claimed in claim 20 wherein:
a plurality of marks are visible on said first segment of said negotiable instrument for enabling the sensing of the position of said second segment with respect to a computer terminal device.

27. The article claimed in claim 24 including further:
a plurality of marks are visible on the second segment of said negotiable instrument for enabling the sensing of the position of a second segment with respect to said terminal device.

28. The article claimed in claim 26 wherein:
a plurality of timing marks are formed on said first segment to enable an input device to read said first segment.

29. The article claimed in claim 27 wherein:
a plurality of timing marks are formed on said second segment to enable an input device to read said second segment.

30. The article claimed in claim 20 wherein:
both said first and second segments have memory parts containing machine readable information.

31. The article claimed in claim 30 wherein:
said first and second segments have horizontal, vertical and timing synchronization marks formed thereon.

32. The article claimed in claim 19 wherein:
said first layer comprises a paper having at least one color forming a base layer.

33. The article claimed in claim 19 wherein:
said first layer comprises a plastic having at least one color.

* * * * *